US007726348B2

(12) United States Patent
Heiman

(10) Patent No.: US 7,726,348 B2
(45) Date of Patent: Jun. 1, 2010

(54) WOVEN SHEETING WITH SPUN YARNS AND SYNTHETIC FILAMENT YARNS

(75) Inventor: Gary L. Heiman, Cincinnati, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 653 days.

(21) Appl. No.: 11/278,155

(22) Filed: Mar. 31, 2006

(65) Prior Publication Data

US 2006/0180229 A1 Aug. 17, 2006

Related U.S. Application Data

(63) Continuation of application No. 10/251,163, filed on Sep. 20, 2002.

(30) Foreign Application Priority Data

Sep. 20, 2002 (EP) ..... 02257405

(51) Int. Cl.
*D03D 1/00* (2006.01)
*D03D 15/00* (2006.01)
*D03D 23/00* (2006.01)

(52) U.S. Cl. ..... 139/383 R; 139/420 R; 139/426 R; 139/426 TW; 139/420 A

(58) Field of Classification Search ..... 139/420 R, 139/426 R, 426 TW, 420 A
See application file for complete search history.

(56) References Cited

U.S. PATENT DOCUMENTS 776,275 A 11/1904 Valentine et al.
1,139,705 A 5/1915 Murch
2,174,991 A * 10/1939 Masland ..... 428/89
2,417,320 A 3/1947 Nutter
3,446,658 A 5/1969 Rose
3,484,332 A 12/1969 Fuhr
3,642,561 A 2/1972 Grobner
3,948,722 A 4/1976 Wheeldon et al.
3,987,614 A 10/1976 Cardinal et al.
4,063,885 A 12/1977 Mares et al.
4,071,647 A 1/1978 McMullen (Continued)

FOREIGN PATENT DOCUMENTS

GB 2287966 10/1995

(Continued)

OTHER PUBLICATIONS

Textile Network Concepts, Inc. (TNC), web site (two pages) "Listings of Spun Yarns and Filaments", (copyright 1998).

(Continued)

*Primary Examiner*—Bobby H Muromoto, Jr.
(74) *Attorney, Agent, or Firm*—Wood, Herron & Evans, LLP

(57) ABSTRACT

Sheeting (10) is woven with warp ends ($E_n$) and fill picks ($P_n$), at least one of which ($E_x$ and/or $P_x$) is a spun yarn (C) and at least one of which ($E_y$ and/or $P_y$, with $x \neq y$) is a synthetic filament yarn (F), or a first plurality of which ($ES_1$ and/or $PS_1$) are each spun yarns (C) and a second plurality of which ($ES_2$ and/or $PS_2$) are each synthetic filament yarns (F).

50 Claims, 2 Drawing Sheets

U.S. PATENT DOCUMENTS 4,168,197 A 9/1979 Michimae et al.
4,191,221 A 3/1980 Boyer
4,333,976 A * 6/1982 Okamoto et al. ..... 428/91
4,450,196 A 5/1984 Kamat
4,469,733 A 9/1984 Seddon
4,534,819 A 8/1985 Payet et al.
4,573,500 A 3/1986 Bouglas
4,578,306 A * 3/1986 Heiman ..... 442/214
4,670,326 A * 6/1987 Heiman ..... 442/214
4,724,183 A 2/1988 Heiman
4,950,530 A 8/1990 Shibatani
4,970,100 A 11/1990 Vohringer
4,977,017 A 12/1990 Schneider
4,996,100 A 2/1991 Druckman
5,167,264 A 12/1992 Kalin
5,299,602 A 4/1994 Barbeau et al.
5,305,813 A 4/1994 Poole
5,330,817 A 7/1994 Arnott et al.
5,364,683 A 11/1994 Flint et al.
5,427,156 A 6/1995 Saito
5,487,936 A 1/1996 Collier
5,495,874 A * 3/1996 Heiman ..... 139/420 A
5,503,096 A * 4/1996 Willey ..... 112/475.23
5,538,781 A 7/1996 Rao et al.
5,556,696 A 9/1996 Pinkus
5,706,590 A 1/1998 Candela et al.
5,783,304 A * 7/1998 Nakajima et al. ..... 428/364
5,932,494 A 8/1999 Crippa
6,062,272 A * 5/2000 Waite ..... 139/420 A
6,164,092 A 12/2000 Menaker
6,250,030 B1 6/2001 Sugimoto et al.
6,435,220 B1 * 8/2002 Smith et al. ..... 139/383 R
6,510,872 B1 * 1/2003 Smith et al. ..... 139/383 R
6,666,235 B2 * 12/2003 Chi et al. ..... 139/420 A
6,782,923 B2 8/2004 Covelli
2003/0092339 A1 5/2003 Covelli
2003/0190853 A1 10/2003 Lovingood

FOREIGN PATENT DOCUMENTS

WO 200205671 1/2002

OTHER PUBLICATIONS

European Search Report for Application No. EP02257405, Dec. 13, 2004.

* cited by examiner

WOVEN SHEETING WITH SPUN YARNS AND SYNTHETIC FILAMENT YARNS

RELATED APPLICATION

This application is a continuation of U.S. patent application Ser. No. 10/251,163, filed Sep. 20, 2002 entitled "Woven Sheeting With Spun Yarns and Synthetic Filament Yarns", which is expressly incorporated herein by reference.

BACKGROUND OF THE INVENTION

I. Field of the Invention

The present invention relates to woven sheeting having warp ends and fill picks, and, more particularly, to such woven sheeting made from spun yarns and synthetic filament yarns.

II. Description of Prior Art

Fabrics for use on or against the skin, such as sheets, pillow cases, undershirts, sleeves, gowns, shirts, and the like may be cut and formed from sheeting comprised of warp end yarns and fill pick yarns woven into a web as is conventional. Selection of yarn for such sheeting often involves a compromise between hand or "feel" and durability. For example, where the yarns are all-natural, 100% cotton, the resultant sheet has a hand that is desirably comfortable and pleasing to the user. However, 100% cotton fabrics do not wear well or readily survive the sometimes harsh laundering procedures to which they may be exposed, especially in commercial or industrial applications such as encountered in connection with hospitals, rest homes, clinics, hotels and the like. In this regard, such fabrics must be able to withstand about 100 to 150 institutional laundry cycles of high temperature or caustic washing, drying, ironing and possibly even steam sterilization.

Similarly, where the web is woven from all synthetic filament yarns, a very durable product is formed, but it suffers from a low hand (i.e., rough feel) that detracts from the web's utility for use on or against the skin.

Various approaches to achieve a balance between durability and hand have been proposed. By way of example, woven sheeting comprised of yarns which are intimately blended spun fibers (which may be all natural or a blend of natural or synthetic) have an acceptable hand, but may not have the desired durability and can be limited by the nature of the spun fiber. In some cases, spun fiber strands and filament strands are twisted into yarns to provide greater durability. While the durability is increased, the twisted yarns have some drawbacks including that they may adversely affect the hand of the resultant web. Others have proposed to use separate, alternating adjacent ends or picks of natural yarns of different character, such as cotton and silk (U.S. Pat. No. 776,275) or mohair and silk (U.S. Pat. No. 1,139,705) in a given weave direction. The latter also suggested use of artificial silk which is believed to have been a reference to rayon or similar cellulosic (i.e., cotton) material, and so was still a natural yarn. These silk-based approaches are not believed to provide a cost-effective and desired balance of hand and durability necessary for fabrics used on or against the skin.

A useful balance of both hand and durability for such sheeting has been achieved by utilizing yarns made from a blend of natural and synthetic material as warp ends, with the weft or fill pick yarns being all natural materials (U.S. Pat. Nos. 4,578,306; 4,679,326 and 4,742,183, all owned by the assignee hereof), or by utilizing yarns of spun cotton staples for the warp ends and polyester filament yarns for the fill (U.S. Pat. No. 5,495,874, also owned by the assignee hereof).

While the approach of these patents have garnered some success, further improvements are desirable.

SUMMARY OF THE INVENTION

I have developed an alternate construction for woven sheeting which is believed to provide a hand that closely resembles the desirable hand typically associated with woven sheeting consisting entirely of intimately blended spun fiber products, yet has better strength like that offered by incorporation of synthetic filament yarn. To this end, and in accordance with certain principles of the present invention, separate spun yarns and synthetic filament yarns are provided in at least one, if not both, of the weaving directions. A woven sheeting in accordance with the principles of the present invention thus includes at least two warp ends which are, respectively, a spun yarn and a synthetic filament yarn, and/or at least two fill picks which are, respectively, a spun yarn and a synthetic filament yarn to thus provide separate spun yarns and synthetic filament yarns in the same weaving direction(s).

In accordance with a further aspect of the present invention, a first plurality of warp ends may be spun yarns and a second plurality of warp ends may be synthetic filament yarns. Alternatively, a first plurality of fill picks may be spun yarns with a second plurality being synthetic filament yarns. Further, both the warp and weft directions may have such first and second pluralities of spun yarns and synthetic filament yarns, in the same or differing amounts. The spun yarns and synthetic filament yarns, in any event, may be woven in a seemingly random spacing spread throughout the sheet or in a predetermined pattern(s) or sub-pattern(s) along the length or width thereof.

Several or all of the spun yarns may advantageously be all natural or a blend of natural and synthetic so as to provide the desired hand or feel, but could also be all synthetic. The synthetic filament yarns are advantageously multi-filament.

The use of separate spun yarns and synthetic filament yarns in the warp and/or the weft (i.e, the fill) offer a woven sheet with a good balance of hand and durability while providing other and significant advantages. In this regard, the woven sheeting of the present invention offers a uniformity of surface or "hand" that more closely resembles the hand or "feel" typically associated with intimately blended spun fiber products, yet retains the inherent enhancement of strength offered by the incorporation of synthetic filament yarn. The woven sheeting of the present invention further offers the design ability to fabricate sheeting of specifically desired fiber blend levels absent the necessity to procure or spin weaving yarns of a specific blended content; enhances the tensile strength and durability of the woven sheeting as compared to some prior sheeting such as those woven exclusively with spun staple yarns, or those addressed in aforementioned U.S. Pat. Nos. 5,495,874, 4,578,306, 4,679,326 and 4,742,183 wherein the synthetic filament yarns and the spun yarns are confined to singular and mutually exclusive weaving directions; and provides for shrinkage properties that more closely approximate those typically associated with intimately blended sheeting utilizing exclusively spun yarns, and can serve to diminish the disparity between warp and weft shrinkage values typical to woven constructions which utilize synthetic filament yarns and spun yarns in mutually exclusive weaving directions, to name a few of the advantages of the present invention.

In accordance with a further aspect of the present invention, some of the synthetic filament yarns may be dyed with single or multiple colors to offer the design ability to fabricate sheeting of certain patterns and/or variegated colors without the necessity for dyeing and/or printing of the fabric subsequent to the weaving process.

In accordance with a yet further aspect of the present invention, an inherent design may be provided, and/or the blend levels and characteristics of the woven sheet varied, in accordance with a repeating pattern(s) or subset pattern(s) of the alternating spun yarns and synthetic filament yarns.

By virtue of the foregoing, there is thus provided woven sheeting having numerous advantages over prior woven sheeting. These and other objectives and advantages of the present invention shall be made apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
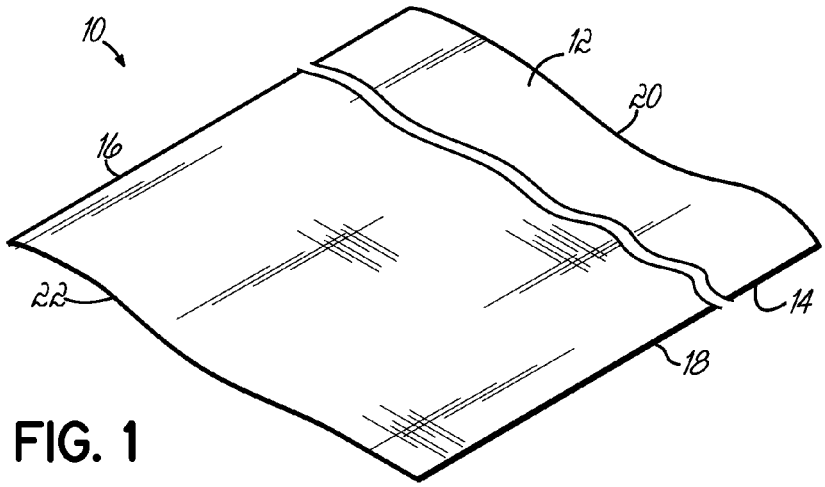
FIG. 1 is an isometric view of a woven sheeting in accordance with the principles of the present invention.
Figure 2:
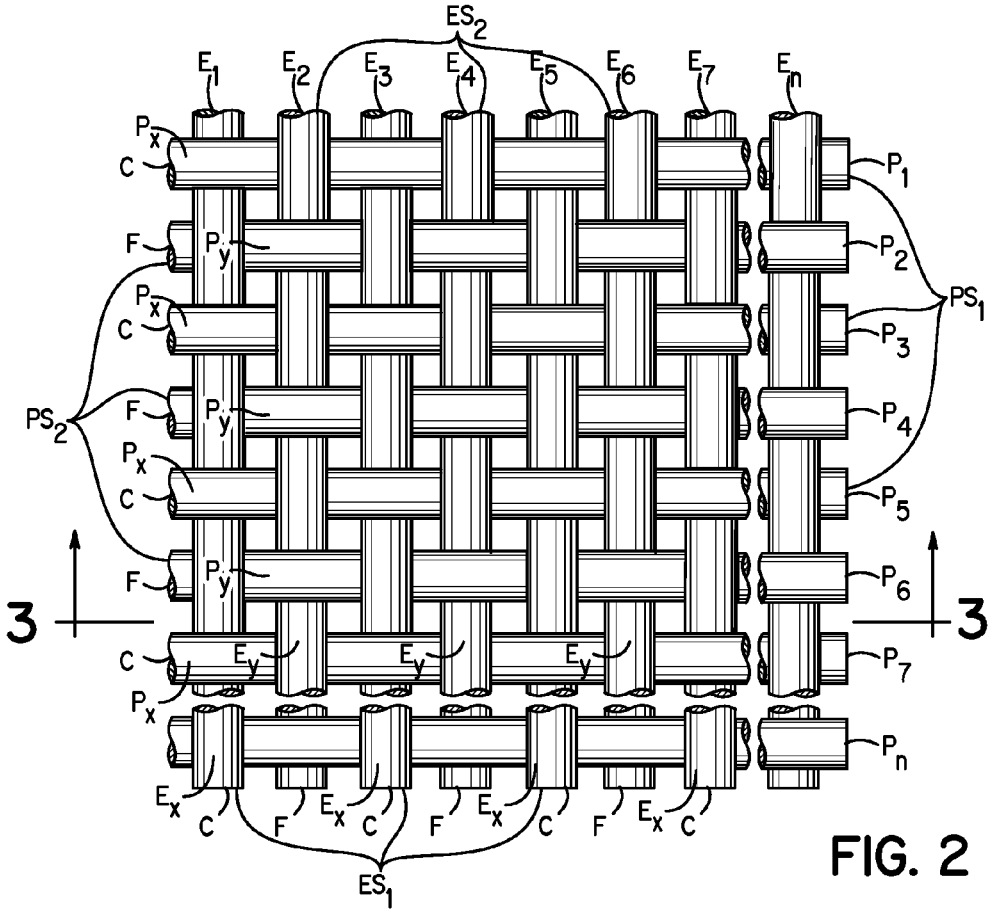
FIG. 2 is an enlarged, fragmentary top plan view, not to scale, of the woven sheeting of FIG. 1.
Figure 3:
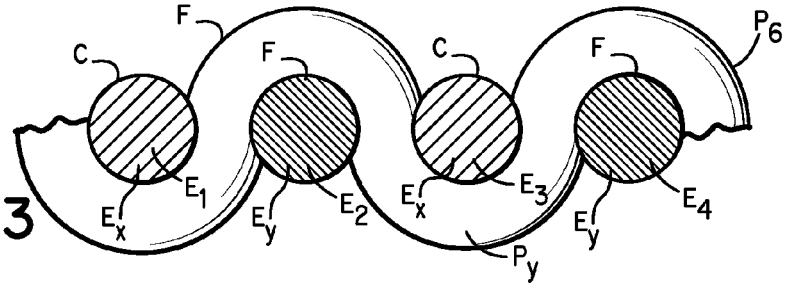
FIG. 3 is a partial, cross-sectional view taken along line 3-3 of FIG. 2.

With reference to FIGS. 1-3 there is shown an embodiment of a woven sheeting 10 in accordance with the principles of the present invention and utilizing separate spun yarns C and synthetic filament yarns F in both the warp and the fill weaving directions, it being understood that the separate yarns C and F could be utilized in only one of the warp weaving direction or the fill weaving direction, with the other weaving direction being comprised of other yarns such as all spun yarns C, synthetic filament yarns F, or twist yarns (not shown), or combinations thereof as desired. Sheeting 10 is plain woven in conventional fashion so as to have a plurality of warp ends $E_1, E_2, \ldots E_n$ and fill picks $P_1, P_2, \ldots P_n$ defining the top 12 and bottom 14 surfaces of sheeting 10 extending between left 16 and right 18 selvages and top or trailing 20 and bottom or leading 22 ends thereof. Each warp end $E_n$ and each fill pick $P_n$ is defined by a yarn the characteristics of which are selected in accordance with the principles of the present invention.

To this end, the fill picks $P_n$ are selected such that at least one of the fill picks $P_x$ is spun yarn C and at least one other of the fill picks $P_y$ ($x \neq y$) is a synthetic filament yarn F, and the warp ends $E_n$ are selected such that at least one of the warp ends $E_x$ is a spun yarn C and at least another of the warp ends $E_y$ (when $x \neq y$) is a synthetic filament yarn F. Advantageously, each of the warp ends $E_n$ of a first plurality or set of ends $ES_1$ (made up of several ends $E_x$) and/or each of the fill picks $P_n$ of a first plurality or set of picks $PS_1$ (made up of several picks $P_x$) is a spun yarn C. Additionally, or alternatively, each of the ends $E_n$ of a second plurality or set of ends $ES_2$ (made up of several ends $E_y$) and/or each of the picks $P_n$ of a second plurality or set of picks $PS_2$ (made up of several picks $P_y$) are synthetic filament yarns F. While the ends and/or picks making up the sets $ES_1$, $ES_2$, $PS_1$ and/or $PS_2$ may be distributed among the plurality of the respective ends $E_n$ and/or picks $P_n$ as desired, it may be advantageous to sequence the yarns in a pattern(s) such that they alternate. By way of example, all of the odd ends $E_n$ and/or picks $P_n$ (where n is an odd number) may comprise set $ES_1$ and/or $PS_1$, and all of the even ends $E_n$ or even picks $P_n$ (where n is an even number) may comprise set $ES_2$ or $PS_2$ so as to define a 1C×1F repeating pattern. This type of alternating pattern is shown in FIG. 2 with set $ES_1$ including ends $E_1$, $E_3$ and $E_5$; set $ES_2$ including ends $E_2$, $E_4$ and $E_6$; set $PS_1$ including picks $P_1$, $P_3$ and $P_5$; and set $PS_2$ including picks $P_2$, $P_4$ and $P_6$. Other patterns are possible by grouping ends or picks together such as 1C×2F, 1C×3F, 1C×4F, 2C×1F, 2C×2F, 2C×3F, 2C×4F, 3C×1F, 3C×2F, 3C×3F, 3C×4F, 4C×1F, 4C×2F, 4C×3F, and 4C×4F, just to name a few. Other patterns will be readily recognized by those skilled in the art and may include subsets of the above patterns (e.g., 1C×2F followed by 4C×3F, etc.) such that the different patterns appear over the length or width of sheeting 10. Further, the pattern(s) and/or subset pattern(s) may be the same or different in each of the weave directions.

While sheeting 10 is shown as comprising separate spun yarns C and synthetic filament yarns F in both the warp and weft weaving directions, the use of such separate yarns in only one of the directions is similarly contemplated. Thus, in the warp direction, warp ends $E_n$ may be as described above with the warp end(s) $E_x$ being spun yarn C and the warp end(s) $E_y$ being synthetic yarn F, but in the weft direction, the fill picks $P_n$ may be any desired yarns such as all spun yarns C (like those used in the warp direction or different, as desired), all synthetic filament yarns F (like those used in the warp direction or different, as desired), twisted yarns (not shown), or a combination thereof. The warp ends $E_n$ may also be located in a pattern(s) or subset pattern(s) as above-described. Alternatively, in the fill direction, fill picks $P_n$ may be separate spun yarns C and synthetic filament yarns F as described above with the fill pick(s) $P_x$ being spun yarn C and the fill pick(s) $P_y$ being synthetic yarn F, but in the weft direction, the warp ends $E_n$ may be any desired yarns such as all spun yarns C (like those used in the warp direction or different, as desired), all synthetic filament yarns F (like those used in the warp direction or different, as desired), twisted yarns (not shown), or a combination thereof. The fill picks $P_n$ may also be formed in a pattern(s) or subset pattern(s) as described above.

The spun yarns C as used in the warp end(s) $E_x$ or fill pick(s) $P_x$ may be of all natural material, such as 100% cotton, may be a blend of synthetic and natural material, and/or may be of all synthetic material depending upon the desired hand or feel of the sheeting 10 and the level of natural-to-synthetic desired in the sheet 10. The level of a natural-to-synthetic may also be easily varied depending upon the number of ends $E_n$ and/or picks $P_n$ in the sets $ES_1$, $PS_1$, $ES_2$, and/or $PS_2$ which utilize spun yarns C and synthetic filament yarns F as above described and/or the pattern(s) or subset pattern(s) thereof. The synthetic filament yarns F may, by way of example and not limitation, be multi-filament synthetic yarns such as 100% polyester multi-filament yarn. Moreover, the synthetic filament yarns F may be used with any combination of natural, blended or synthetic spun yarns C.

While not being limited thereto, an advantageous range of counts for the spun yarns C is between 16/1 to 50/1 (whether natural, blended or synthetic) and from 70 to 200 denier for the synthetic filament yarns F. The sheeting 10 could run in various threads per inch construction such as from about 90 to about 250 threads per square inch. By way of example, one woven sheeting 10 may be 20/1 100% cotton spun yarn for all warp ends $E_n$, and a combination of 30/1 100% polyester spun yarn C and 150 denier/48 filament 100% polyester multi-filament yarns F for fill picks $P_x$ and $P_y$, respectively, woven in a 69×50 (119) threads per square inch construction.

Figure 4:
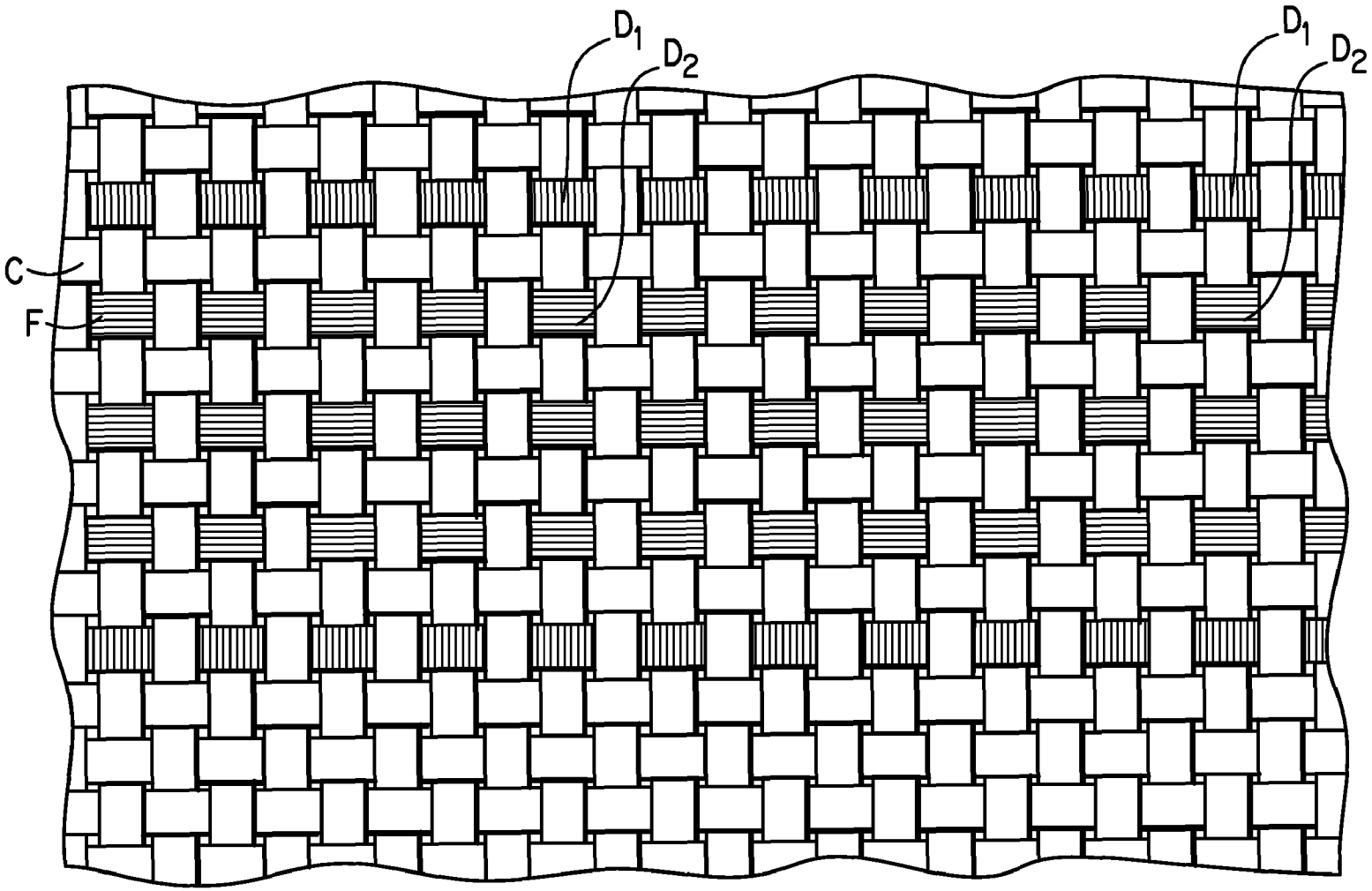
FIG. 4 is an enlarged, fragmentary top plan view, not to scale, of an alternative embodiment of a woven sheeting in accordance with the principles of the present invention.

For additional variations, and with reference to FIG. 4, selected ones of the synthetic yarns F for warp end(s) $E_x$ and/or fill pick(s) $P_x$ may be dyed with single or multiple colors as at $D_1$ and/or $D_2$ to offer the design ability to fabricate sheeting of certain patterns and/or variegated colors without the necessity for dyeing and/or printing of the fabric subsequent to the weaving process.

The use of separate spun and synthetic filament yarns in the warp and/or the weft directions offers a woven sheet with a good balance of hand and durability while providing other and significant advantages. In this regard, the woven sheeting of the present invention offers a uniformity of surface or hand that more closely resembles the hand typically associated with intimately blended spun fiber products, yet retains the inherent enhancement of strength offered by the incorporation of synthetic filament yarn. The woven sheeting of the present invention further offers the design ability to fabricate sheeting of specifically desired fiber blend levels absent the necessity to procure or spin weaving yarns of a specific blended content; enhances the tensile strength and durability of the woven sheeting as compared to some prior sheeting such as those woven exclusively with spun staple yarn, or those addressed in aforementioned U.S. Pat. Nos. 5,495,874, 4,578,306, 4,679,326 and 4,742,183 wherein the synthetic filament yarns and the spun yarns are confined to singular and mutually exclusive weaving directions; and provides for shrinkage properties that more closely approximate those typically associated with intimately blended sheeting utilizing exclusively spun yarns, and can serve to diminish the disparity between the warp and weft shrinkage values typical to woven constructions which utilize synthetic filament yarns and spun yarns in mutually exclusive weaving directions, to name a few of the advantages of the present invention.

While the present invention has been illustrated by the description of embodiments thereof and specific examples, and while the embodiments have been described in considerable detail, it is not intended to restrict or in any way limit the scope of the appended claims to such detail. Additional advantages and modifications will readily appear to those skilled in the art. For example, the spun yarns C in a given weaving direction need not all be the same, nor need the synthetic filament yarns F in a given weaving direction be all the same. Moreover, while multi-filament synthetic yarns F are advantageous, a sufficiently thin or texturized, but durable, monofilament yarn which will not deleteriously affect the hand may be used, if available. Also, while "alternating" is typically understood to refer to a repeating back and forth pattern by adjacent rows, that term is not used in such a limiting sense in describing the invention herein and may include a sheeting in which there is a switch between spun yarns C and synthetic yarns F at least once along the length thereof or to include multiple switches between such yarns in one or more repeating patterns. Additionally, while ends $E_n$ and picks $P_n$ are shown equally spaced and with an equal density, it will be appreciated that there may be a greater density of warp ends $E_n$ than fill picks $P_n$. The invention in its broader aspects is therefore not limited to the specific details, representative apparatus and methods and illustrative examples shown and described. Accordingly, departures may be made from such details without departing from the scope or spirit of applicant's general inventive concept.

Having described the invention, what is claimed is:

1. A web comprising woven bed sheeting including warp ends and fill picks woven together, at least two of the warp ends being, respectively, a spun yarn and a synthetic filament yarn, the warp ends and fill picks defining a hand for use of the woven bed sheeting comfortably on or against the skin.

2. The web of claim 1, the spun yarn being natural.

3. The web of claim 1, the spun yarn being a blend of synthetic and natural.

4. The web of claim 1, the spun yarn being synthetic.

5. The web of claim 1, the synthetic filament yarn being multi-filament.

6. The web of claim 1, a first plurality of the warp ends being spun yarns and a second plurality of the warp ends being synthetic filament yarns.

7. The web of claim 6, the spun yarns each being natural.

8. The web of claim 6, the spun yarns each being a blend of synthetic and natural.

9. The web of claim 6, the spun yarns being synthetic.

10. The web of claim 6, the synthetic filament yarns each being multi-filament.

11. The web of claim 6, at least selected ones of the second plurality of the warp end synthetic filament yarns being dyed.

12. The web of claim 6, the first and second plurality of warp ends being woven in an alternating fashion.

13. The web of claim 12, the first and second plurality of warp ends being woven in a repeating alternating fashion.

14. A web comprising woven bed sheeting including warp ends and fill picks woven together, at least two of the fill picks being, respectively, a spun yarn and a synthetic filament yarn, the warp ends and fill picks defining a hand for use of the woven bed sheeting comfortably on or against the skin.

15. The web of claim 14, the spun yarn being natural.

16. The web of claim 14, the spun yarn being a blend of synthetic and natural.

17. The web of claim 14, the spun yarn being synthetic.

18. The web of claim 14, the synthetic filament yarn being multi-filament.

19. The web of claim 14, a first plurality of the fill picks being spun yarns and a second plurality of the fill picks being synthetic filament yarns.

20. The web of claim 19, the spun yarns each being natural.

21. The web of claim 19, the spun yarns each being a blend of synthetic and natural.

22. The web of claim 19, the spun yarns being synthetic.

23. The web of claim 19, the synthetic filament yarns each being multi filament.

24. The web of claim 19, at least selected ones of the second plurality of the warp end synthetic filament yarns being dyed.

25. The web of claim 19, the first and second plurality of fill picks being woven in an alternating fashion.

26. The web of claim 25, the first and second plurality of fill picks being woven in a repeating alternating fashion.

27. A web comprising woven bed sheeting including warp ends and fill picks woven together, at least two of the warp ends being, respectively, a spun yarn and a synthetic filament yarn, and at least two of the fill picks being, respectively, a spun yarn and a synthetic filament yarn, the warp ends and fill picks defining a hand for use of the woven bed sheeting comfortably on or against the skin.

28. The web of claim 27, the warp end spun yarn being natural.

29. The web of claim 27, the warp end spun yarn being a blend of synthetic and natural.

30. The web of claim 27, the warp end spun yarn being synthetic.

31. The web of claim 27, the warp end synthetic filament yarn being multi-filament.

32. The web of claim 27, the fill pick spun yarn being natural.

33. The web of claim 27, the fill pick spun yarn being a blend of synthetic and natural.

34. The web of claim 27, the fill pick spun yarn being synthetic.

35. The web of claim 27, the fill pick synthetic filament yarn being multi-filament.

36. The web of claim 27, a first plurality of the warp ends being spun yarns and a second plurality of the warp ends being synthetic filament yarns, and a first plurality of the fill ends being spun yarns and a second plurality of the fill ends being synthetic filament yarns.

37. The web of claim 36, the spun yarns each being natural.

38. The web of claim 36, the spun yarns each being a blend of synthetic and natural.

39. The web of claim 36, the spun yarns each being synthetic.

40. The web of claim 36, the synthetic filament yarns each being multi filament.

41. The web of claim 36, at least selected ones of the second plurality of the warp end synthetic filament yarns being dyed.

42. The web of claim 36, at least selected ones of the second plurality of the fill pick synthetic filament yarns being dyed.

43. The web of claim 36, the first and second plurality of warp ends being woven in an alternating fashion.

44. The web of claim 43, the first and second plurality of warp ends being woven in a repeating alternating fashion.

45. The web of claim 43, the first and second plurality of fill picks being woven in a repeating alternating fashion.

46. The web of claim 36, the first and second plurality of fill picks being woven in a repeating alternating fashion.

47. The web of claim 46, the first and second plurality of fill picks being woven in a repeating alternating fashion.

48. A web comprising woven bed sheeting including warp ends and fill picks, the warp ends being of alternating spun yarns and synthetic filament yarns, and the fill picks being of alternating spun yarns and synthetic filament yarns, the warp ends and fill picks defining a hand for use of the woven bed sheeting comfortably on or against the skin.

49. A web comprising woven bed sheeting including warp ends and fill picks, the warp ends being of alternating spun yarns and synthetic filament yarns, the warp ends and fill picks defining a hand for use of the woven bed sheeting comfortably on or against the skin.

50. A web comprising woven bed sheeting including warp ends and fill picks, the fill picks being of alternating spun yarns and synthetic filament yarns, the warp ends and fill picks defining a hand for use of the woven bed sheeting comfortably on or against the skin.

* * * * *